US008228286B2

(12) United States Patent
Choi et al.

(10) Patent No.: US 8,228,286 B2
(45) Date of Patent: Jul. 24, 2012

(54) DISPLAY DEVICE HAVING VARIABLE BACKLIGHT AND METHOD DRIVING THE SAME

(75) Inventors: Kyung-Uk Choi, Asan-si (KR); Sang-Gil Lee, Seoul (KR); Yun-Jae Park, Yongin-si (KR)

(73) Assignee: Samsung Electronics Co., Ltd. (KR)

( * ) Notice: Subject to any disclaimer, the term of this patent is extended or adjusted under 35 U.S.C. 154(b) by 508 days.

(21) Appl. No.: 12/477,849

(22) Filed: Jun. 3, 2009

(65) Prior Publication Data

US 2010/0033513 A1 Feb. 11, 2010

(30) Foreign Application Priority Data

Aug. 8, 2008 (KR) ..... 10-2008-0078158

(51) Int. Cl.
*G09G 3/36* (2006.01)

(52) U.S. Cl. ..... 345/102

(58) Field of Classification Search ..... 345/102
See application file for complete search history.

(56) References Cited

U.S. PATENT DOCUMENTS

| | | | | |
|---|---|---|---|---|
| 2002/0122020 | A1* | 9/2002 | Moon et al. | 345/89 |
| 2003/0112378 | A1* | 6/2003 | Okunuki et al. | 348/687 |
| 2005/0087671 | A1* | 4/2005 | Park | 250/205 |
| 2005/0140640 | A1* | 6/2005 | Oh et al. | 345/102 |
| 2007/0216636 | A1* | 9/2007 | Lo | 345/102 |
| 2007/0222740 | A1* | 9/2007 | Hanada | 345/102 |
| 2008/0284721 | A1* | 11/2008 | Hasegawa | 345/102 |
| 2008/0309610 | A1* | 12/2008 | Yoshida et al. | 345/102 |
| 2009/0002285 | A1* | 1/2009 | Baba et al. | 345/77 |
| 2009/0015601 | A1* | 1/2009 | Kim | 345/690 |
| 2009/0091528 | A1* | 4/2009 | Hong | 345/102 |

FOREIGN PATENT DOCUMENTS

| | | |
|---|---|---|
| JP | 2005-208314 | 8/2005 |
| KR | 10-2007-0003150 | 1/2007 |
| KR | 10-2007-0094371 | 9/2007 |

* cited by examiner

*Primary Examiner* — Adam J Snyder
(74) *Attorney, Agent, or Firm* — Innovation Counsel LLP

(57) ABSTRACT

Disclosed are a display device and a method of driving the same capable of improving display quality and reducing the manufacturing cost. A display device includes a display panel displaying images corresponding to image signals, a light-emission block supplying backlight to the display panel, and a backlight driver outputting a light data signal for determining luminance of backlight. One of a plurality of linear gamma curves is selected from a lookup table in accordance with average image luminance during prescribed frames, and the duty ratio of the light data signal is determined on the basis of the selected linear gamma curve. Each of the linear gamma curves represents the relationship between the average image luminance and the duty ratio of the light data signal.

20 Claims, 9 Drawing Sheets

DISPLAY DEVICE HAVING VARIABLE BACKLIGHT AND METHOD DRIVING THE SAME

CROSS-REFERENCE TO RELATED APPLICATION

This application claims priority to Korean Patent Application No. 10-2008-0078158 filed on Aug. 8, 2008 in the Korean Intellectual Property Office, and all the benefits accruing therefrom under 35 U.S.C. §119, the contents of which are incorporated herein by reference in its entirety.

BACKGROUND OF THE INVENTION

1. Field of the Invention

The present invention relates to a display device and a method of driving the same, and more particularly, to a display device and a method of driving the same while improving display quality and reducing the manufacturing cost.

2. Description of the Related Art

A display device includes a display panel which comprises of a first display plate having pixel electrodes, a second display plate having a common electrode, and a liquid crystal molecular layer having anisotropic dielectric interposed between the first display plate and the second display plate. An electric voltage is applied between the pixel and common electrodes, and the amount of light transmitting the display panel is controlled in accordance with the electric voltage. Thus, a desired image is displayed. The display device is not of a self-luminous type, and it includes a light-emission unit that supplies light to the display panel.

Recently, to improve display quality, a technology for adjusting the luminance of light from the light-emission unit in accordance with an image displayed on the display panel has been developed.

SUMMARY OF THE INVENTION

Aspects of the present invention provide a display device which is capable of improving display quality and reducing the manufacturing cost.

Aspects of the present invention also provide a method of driving a display device that is capable of improving display quality and reducing the manufacturing cost.

However, the aspects, features and advantages of the present invention are not restricted to the ones set forth herein. The above and other aspects, features and advantages of the present invention will become more apparent to one of ordinary skill in the art to which the present invention pertains by referencing a detailed description of the present invention given below.

According to an aspect of the present invention, a display device is provided including: a display panel to display images corresponding to image signals; a light-emitting block supplying backlight to the display panel; and a backlight driver outputting a light data signal for determining luminance of backlight. One of a plurality of linear gamma curves is selected in accordance with average image luminance during prescribed frames, and the duty ratio of the light data signal is determined on the basis of the selected linear gamma curve. Each of the linear gamma curves represents the relationship between the average image luminance and the duty ratio of the light data signal.

According to another aspect of the present invention, a method is provided to drive a display device, the method includes: extracting average image luminance on a display panel during prescribed frames; selecting one of a plurality of linear gamma curves in accordance with the extracted average image luminance; outputting a light data signal whose duty ratio is determined on the basis of the selected linear gamma curve; and supplying backlight corresponding to the light data signal. Each of the linear gamma curves represents the relationship between the average image luminance and the duty ratio of the light data signal.

BRIEF DESCRIPTION OF THE DRAWINGS

The above and other aspects and features of the present invention will become more apparent by describing in detail exemplary embodiments thereof with reference to the attached drawings, in which.

DETAILED DESCRIPTION OF THE EXEMPLARY EMBODIMENTS

The present disclosure of invention may be understood more readily by reference to the following detailed description of preferred embodiments and the accompanying drawings. The present invention may, however, be embodied in different forms and should not be construed as being limited to the embodiments set forth herein. Rather, these embodiments are disclosed thoroughly and will fully convey the concept of the invention to those skilled in the art. Like numbers refer to like elements throughout.

It will be understood that when an element or layer is referred to as being "on", "connected to" or "coupled to" another element or layer, it can be directly on, connected or coupled to the other element or layer or intervening elements or layers may be present. In contrast, when an element is referred to as being "directly on", "directly connected to" or "directly coupled to" another element or layer, there are no intervening elements or layers present. As used herein, the term "and/or" includes any and all combinations of one or more of the associated listed items.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

A display device and a method of driving it according to an embodiment of the present invention will be described with reference to FIGS. 1 to 7.

Figure 1:
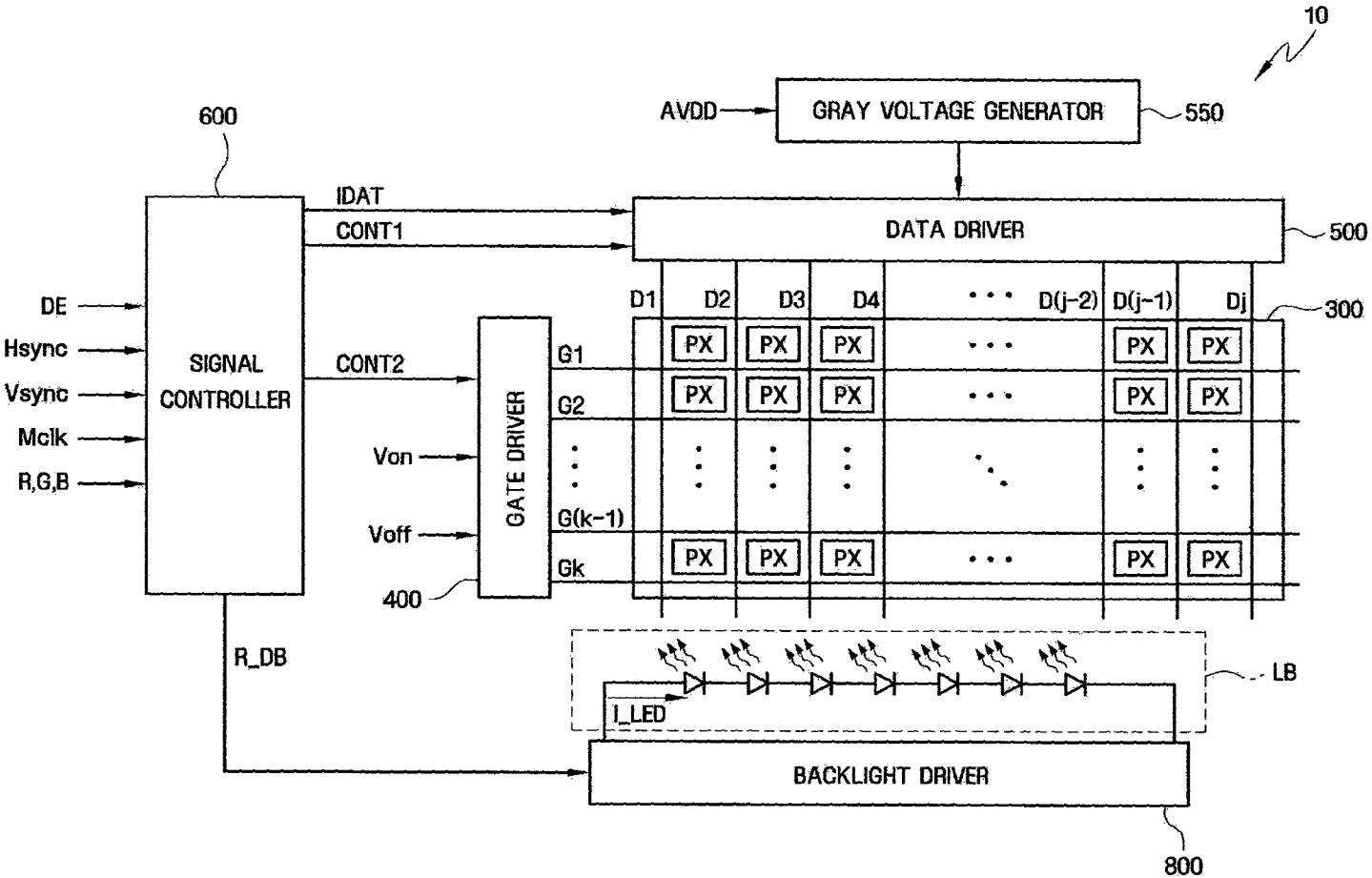
FIG. 1 is a block diagram illustrating a display device and a method of driving the same according to an embodiment of the present invention.
Figure 2:
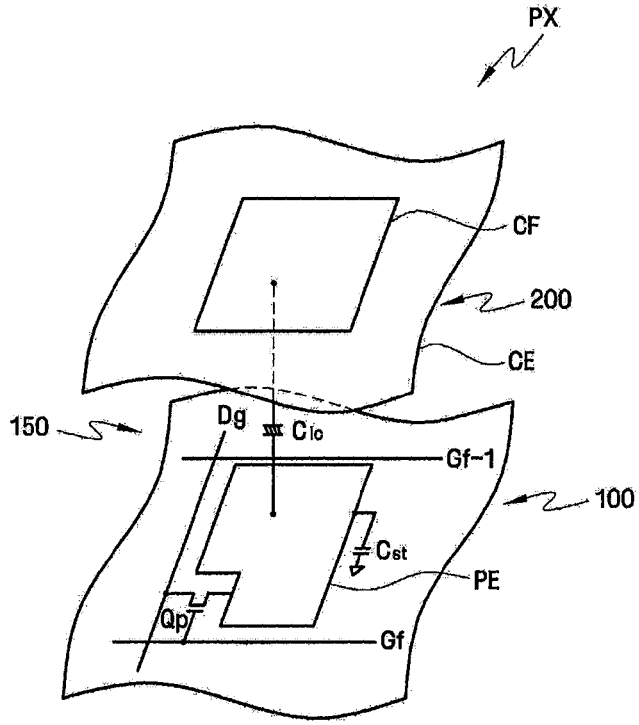
FIG. 2 is an equivalent circuit diagram of one pixel in a display panel shown in FIG. 1.

FIG. 1 is a block diagram illustrating a display device and a method of driving a display device according to an embodiment of the present invention. FIG. 2 is an equivalent circuit diagram of one pixel in a display panel shown in FIG. 1.

Referring to FIG. 1, a display device 10 includes a display panel 300, a signal controller 600, a gray voltage generator 550, a gate driver 400, a data driver 500, a backlight driver 800, and a light-emission block LB connected to the backlight driver 800.

The display panel 300 includes a plurality of gate lines G1 to Gk, a plurality of data lines D1 to Dj, and a plurality of pixels PX. Though not shown, each pixel PX may be one of a red subpixel, a green subpixel, and a blue subpixel. The pixels PX are defined at intersections of the gate lines G1 to Gk and the data lines D1 to Dj.

As described below, the signal controller 600 outputs a second image signal IDAT to the data driver 500, and the data driver outputs an image data voltage corresponding to the second image signal IDAT. Each pixel PX displays an image in response to the image data voltage. Thus, the pixels PX in the display panel 300 display an image corresponding to the second image signal IDAT.

FIG. 2 shows an equivalent circuit of one pixel. A pixel PX connected to an f-th (where f=1 to k) gate line Gf and a g-th (where g=1 to j) data line Dg includes a switching element Qp connected to the gate line Gf, and a data line Dg, and a liquid crystal capacitor Clc and a storage capacitor Cst connected to the switching element Qp. As shown in the drawing, the liquid crystal capacitor Clc is formed by two electrodes, a pixel electrode PE of a first display plate 100 and a common electrode CE of a second display plate 200, and a liquid crystal molecular layer 150 interposed between the two electrodes. A color filter CF is partially formed on the common electrode CE.

Returning to FIG. 1, the signal controller 600 receives first image signals R, G, and B and external control signals (DE, Hsync, Vsync, and Mclk) for controlling display of the first image signals R, G, and B, and outputs the second image signal IDAT, a data control signal CONT1, a gate control signal CONT2, and average image luminance R_DB.

The signal controller 600 controls images to be displayed on the display panel 300.

Specifically, the signal controller 600 converts an image signal in a format to be processed by the data driver 500 or converts the first image signals R, G, and B into the second image signal IDAT in order to improve display quality, and outputs the converted image signal. The signal controller 600 receives the external control signals from the outside, and generates the data control signal CONT1 and the gate control signal CONT2. Examples of the external control signals include a data enabling signal DE, a horizontal synchronizing signal Hsync, and a vertical synchronizing Vsync, and a main clock signal Mclk. The gate control signal CONT2 is used to control the operation of the gate driver 400, and the data control signal CONT1 is used to control the operation of the data driver 500. The signal controller 600 will be described below in detail with reference to FIG. 3.

The gray voltage generator 550 supplies a voltage corresponding to the second image signal IDAT to the data driver 500. The gray voltage generator 550 divides a driving voltage AVDD in accordance with the gray level of the second image signal IDAT, and supplies the divided voltage to the data driver 500. The gray voltage generator 550 supplies the driving voltage AVDD at a high level if the gray level of the second image signal IDAT is at the maximum, and supplies a ground voltage at low level (0V) if the gray level of the second image signal IDAT is at the minimum. Though not shown, the gray voltage generator 550 include a plurality of resistors in series between a node to which the driving voltage AVDD is applied and the ground, thereby dividing the driving voltage AVDD. The internal circuit of the gray voltage generator 550 is not limited thereto, but it may be embodied in various ways.

The gate driver 400 receives the gate control signal CONT2 from the signal controller 600 and applies gate signals to the gate lines G1 to Gk. The gate signals are formed by combinations of a gate-on voltage Von and a gate-off voltage Voff supplied from a gate-on/off voltage generator (not shown). The gate control signal CONT2 is used to control the operation of the gate driver 400, and it may include a vertical start signal (see STV in FIG. 3) for starting the operation of the gate driver 400, a gate clock signal (see CPV in FIG. 3) for determining the output timing of the gate-on voltage, and an output enable signal (see OE in FIG. 3) for determining the pulse width of the gate-on voltage.

The data driver 500 receives the data control signal CONT1 from the signal controller 600 and applies a voltage corresponding to the second image signal IDAT to the data lines D1 to Dj. The voltage corresponding to the second image signal IDAT may be a voltage supplied from the gray voltage generator 550. That is, the voltage corresponding to the second image signal IDAT may be a voltage obtained by dividing the driving voltage AVDD in accordance with the gray level of the second image signal IDAT. The data control signal CONT1 includes signals for controlling the operation of the data driver 500. Examples of the signals for controlling the operation of the data driver 500 include a horizontal start signal (see STH in FIG. 3) for starting the operation of the data driver 500 and an output instruction signal (see TP in FIG. 3) for instructing the output of the image data voltage.

The backlight driver 800 generates a light data signal (see LDAT in FIG. 4) for determining the luminance of backlight, and controls the luminance of backlight from the light-emission block LB in accordance with the light data signal. The luminance of the light-emission block LB varies depending on the duty ratio of the light data signal LDAT. The duty ratio of the light data signal LDAT is determined on the basis of one linear gamma curve selected from a plurality of linear gamma curves. The selection of one linear gamma curve is made in accordance with the average image luminance of images to be displayed on the display panel 300 during prescribed frames. The internal structure and operation of the backlight driver 800 will be described below in detail with reference to FIGS. 4 and 5. A "linear gamma curve", as used herein, is intended to include gamma curves whose duty ratio either changes linearly or remains constant as a function of the gray level.

The light-emission block LB includes at least one light source and supplies backlight to the display panel 300. For example, as shown in the drawing, the light-emission block LB may include a plurality of light-emitting diodes LED, which are a type of dot light sources. The light source may be a surface light. A current I_LED in the LED is determined by the light data signal (see LDAT in FIG. 4), which is generated by the backlight driver 800. That is, the luminance of the light-emission block LB is controlled by the backlight driver 800.

Figure 3:
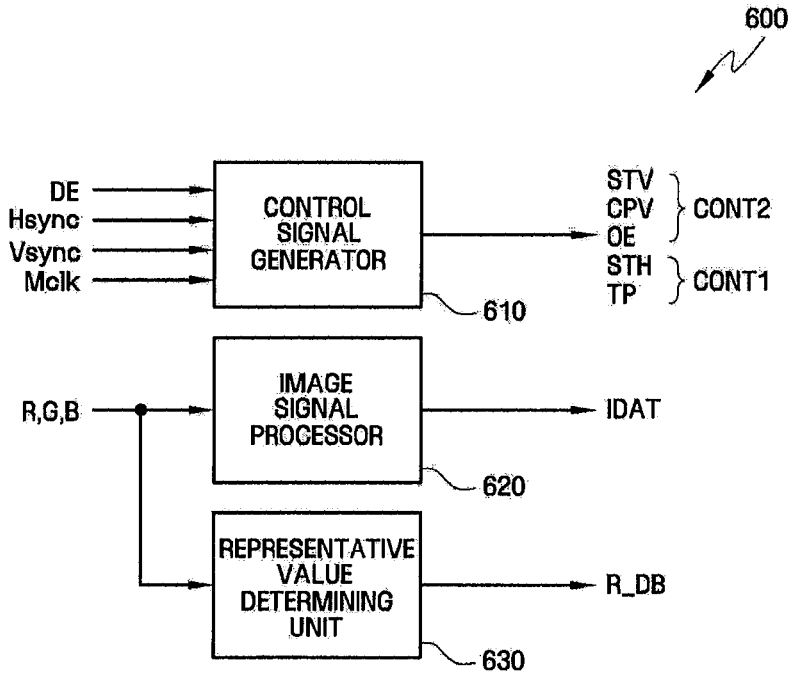
FIG. 3 is a block diagram illustrating a signal controller shown in FIG. 1.

The signal controller 600 shown in FIG. 1 will be described in detail with reference to FIG. 3. FIG. 3 is a block diagram illustrating the signal controller.

Referring to FIG. 3, the signal controller 600 includes a control signal generator 610, an image signal processor 620, and a representative value determining unit 630.

The control signal generator 610 receives the external control signals (DE, Hsync, Vsync, and Mclk) and outputs the data control signal CONT1 and the gate control signal CONT2. For example, the control signal generator 610 outputs the vertical start signal STV for starting the operation of the gate driver 400, the gate clock signal CPV for determining the output timing of the gate-on voltage, the output enabling signal OE for determining the pulse width of the gate-on voltage, the horizontal start signal STH for starting the operation of the data driver 500, and the output instruction signal TP for instructing the output of the image data voltage.

The image signal processor 620 converts an image signal in a format to be processed by the data driver 500 or converts the first image signals R, G, and B into the second image signal IDAT in order to improve display quality, and outputs the converted image signal. The second image signal IDAT may be a signal obtained by converting the first image signals R, G, and B for overdriving in order to improve display quality. A detailed description of overdriving will be omitted.

The representative value determining unit 630 determines the average image luminance R_DB to be displayed on the display panel 300. For example, as shown in the drawing, the representative value determining unit 630 receives the first image signals R, G, and B and averages the gray levels of the first image signals R, G, and B to determine the average image luminance R_DB. Alternatively, the average image luminance R_DB may be a value obtained by averaging the gray levels of the received second image signals IDAT.

Figure 4:
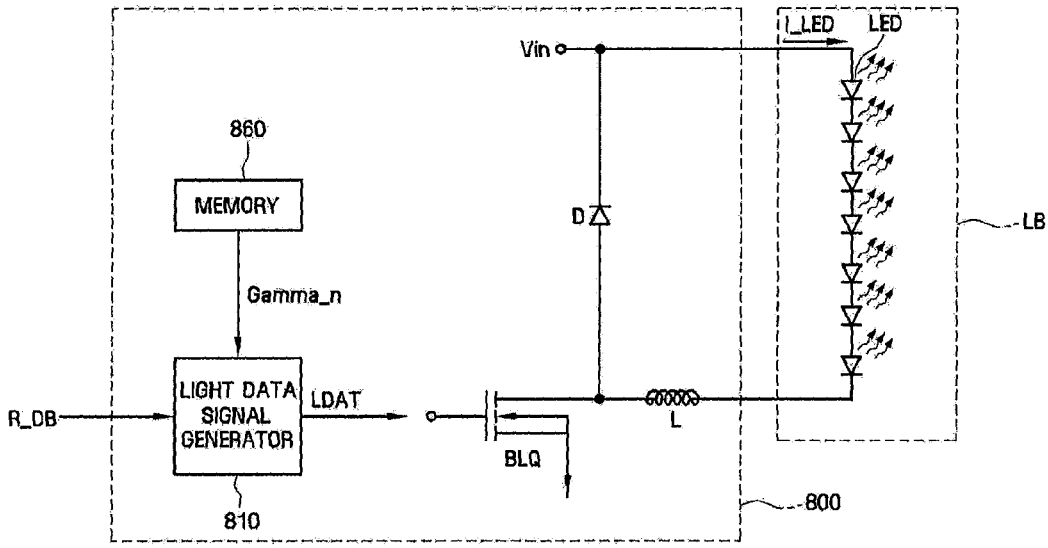
FIG. 4 is a diagram illustrating the operation of a backlight driver and a light-emission block shown in FIG. 1.

FIG. 4 is a diagram illustrating the operation of the backlight driver and the light-emission block shown in FIG. 1.

Referring to FIG. 4, the backlight driver 800 includes a light data signal generator 810, a memory 860, a switching element BLQ, a diode D, and an inductor L.

The light data signal generator 810 receives the average image luminance R_DB, generates the light data signal LDAT for determining the luminance of backlight, and outputs the generated light data signal LDAT to the switching element BLQ. The light data signal LDAT may be a PWM (Pulse Width Modulation) signal. The pulse width of the PWM signal corresponds to the duty ratio of the light data signal LDAT. If the duty ratio of the light data signal LDAT is large, the luminance of backlight from the light-emission block LB is increased.

The light data signal generator 810 determines a gamma coefficient Gamma_n from the memory 860 on the basis of the average image luminance R_DB, and generates the light data signal LDAT whose duty ratio corresponds to the determined gamma coefficient Gamma_n. The light data signal generator 810 selects one linear gamma curve from among a plurality of linear gamma curves, which are stored in the memory in forms of a lookup table, and determines the gamma coefficient Gamma_n on the basis of the selected linear gamma curve. The selection of one linear gamma curve is made in accordance with the average image luminance to be displayed on the display panel 300 during prescribed frames. This will be described below with reference to FIG. 6.

FIG. 4 shows a case where the light data signal generator 810 is physically separated from the signal controller (see reference numeral 600 in FIG. 1) and is included in the backlight driver 800. Alternatively, the light data signal generator 810 may be included in the signal controller 600. In this case, the light data signal generator 810 in the signal controller 600 generates the light data signal LDAT and supplies the light data signal LDAT to the backlight driver 800.

Figure 5:
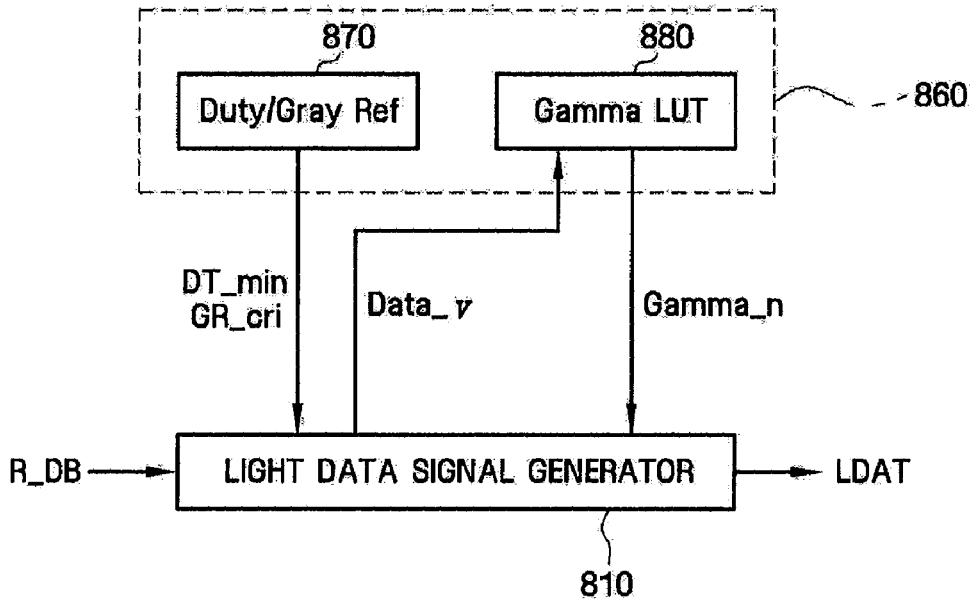
FIG. 5 is a block diagram illustrating a memory and a light data signal controller shown in FIG. 4.

The memory 860 stores duty/gray reference values (see Duty/Gray Ref. 870 in FIG. 5) and a plurality of linear gamma curves in forms of a lookup table (see Gamma LUT 880 in FIG. 5). The memory 860 may include a non-volatile memory, in particular, an EEPROM (Electrically Erasable Programmable Read-Only Memory). If the EEPROM is used, information in the memory 860 may be stably stored for a long time without power, and a user may repeatedly correct the information. With the EEPROM incorporated into the system, information may be corrected. This will be described below with reference to FIGS. 5 and 6.

The operations of the switching element BLQ, the diode D, and the inductor L in the backlight driver 800 and the current I_LED carried in the light-emitting diode LED in response to the light data signal LDAT input to the switching element BLQ will now be described.

The luminance of the light-emission block BL, that is, the luminance of backlight from the light-emission block BL to the display panel (see reference numeral 300 in FIG. 1) is controlled by the light data signal LDAT.

The operation will now be described in detail. If the light data signal LDAT is at high level, the switching element BLQ of the backlight driver 800 is turned on, and a power supply voltage Vin is supplied to the light-emitting diode LED in the light-emission block LB. Thus, a current is carried through the light-emitting diodes LED and the inductor L. At this time, the inductor L stores energy from the current. If the light data signal LDAT is at low level, the switching element BLQ is turned off, and the light-emitting diode LED, the inductor L, and the diode D form a closed circuit carrying a current. At this time, energy stored in the inductor L is discharged and the current is decreased. The turn-on time of the switching element BLQ is adjusted in accordance with the duty ratio of the light data signal LDAT. Therefore, the luminance of the light-emission block LB is controlled in accordance with the duty ratio of the light data signal LDAT.

The operation of the light data signal generator 810 shown in FIG. 4 to determine the gamma coefficient Gamma_n from the memory 860 will be described in detail with reference to FIGS. 5 and 6. FIG. 5 is a block diagram illustrating the memory and the light data signal controller shown in FIG. 4.

Referring to FIG. 5, the memory 860 stores the duty/gray reference values 870 and a plurality of gamma curves 880 in forms of a lookup table.

The duty/gray reference values 870 means minimum duty ratios DT_min and critical luminance GR_cri. The minimum duty ratios DT_min and the critical luminance GR_cri stored in the memory 860 may be set by the user. In addition, as described above, if the memory 860 is formed by an EEPROM, the minimum duty ratios DT_min and the critical luminance GR_cri stored in the memory 860 may be changed by the user.

A plurality of linear gamma curves 880 in forms of a lookup table may be stored by the light data signal generator 810. The light data signal generator 810 reads from the memory 860 the minimum duty ratio DT_min and the critical luminance GR_cri, generates a plurality of linear gamma curves Data_γ, and stores them in the memory 860 in forms of a lookup table. The light data signal generator 810 determines the gamma coefficient Gamma_n on one of the linear gamma curves 880 in the lookup table stored in the memory 860 according to the average image luminance R_DB.

The process to select one of the linear gamma curves in accordance with the average image luminance R_DB during prescribed frames and to determine the duty ratio of the light data signal LDAT on the basis of the selected linear gamma curve will be described with reference to FIG. 6.

Figure 6:
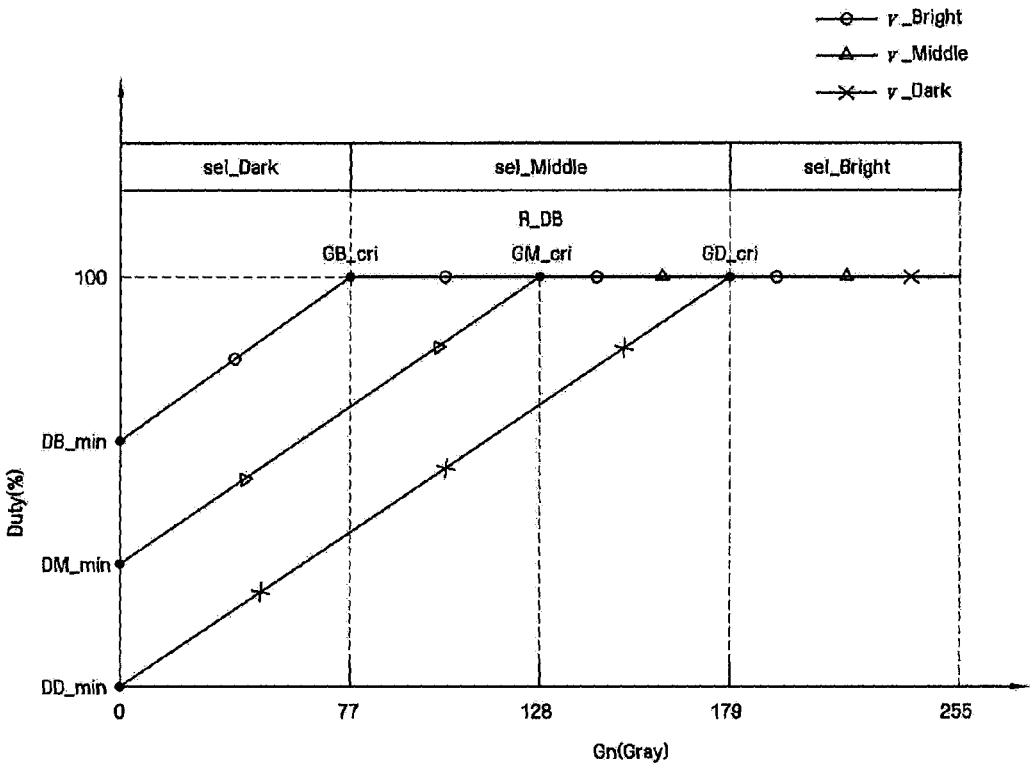
FIG. 6 is a graph illustrating the operation of the light data signal controller shown in FIG. 5 to select a gamma coefficient.

FIG. 6 is a graph illustrating the operation of the light data signal controller 810 shown in FIG. 5 to select the gamma coefficient.

Each of the linear gamma curves γ_Bright, γ_Middle, and γ_Dark represents a relationship between the average image luminance Gn and the duty ratio Duty (%) of the light data signal. In particular, each of the linear gamma curves, γ_Bright, γ_Middle, and γ_Dark, may represent the relationship between the average image luminance Gn in a current frame and the duty ratio Duty of the light data signal. The x-coordinate axis represents the average image luminance Gn in gray levels, and the y-coordinate axis represents the duty ratio Duty (%) of the light data signal. In FIG. 6, the average image luminance Gn may be the average gray level of the first image signals (see R, G, and B in FIG. 1) or the second image signals (see IDAT in FIG. 1) in one frame. FIG. 6 shows an example where the first image signal or the second image signal has 256 gray levels. In this case, the The minimum gray level is 0, and the maximum gray level is 255.

The linear gamma curves γ_Bright, γ_Middle, and γ_Dark are individually determined by the minimum duty ratios DB_min, DM_min, and DD_min, which are duty ratios corresponding to the minimum image luminance, and the critical luminance GD_cri, GM_cri, and GB_cri, which are the minimum values of the average image luminance corresponding to the maximum duty ratio of the light data signal. In FIG. 6, the minimum image luminance corresponds to the minimum gray level 0, and the maximum duty ratio of the light data signal is 100%.

The portions of the gamma curves γ_Bright, γ_Middle, and γ_Dark are formed by connecting points corresponding to the minimum duty ratios DB_min, DM_min, and DD_min and points corresponding to the critical luminance GD_cri, GM_cri, and GB_cri, and the constant portions by lines showing the maximum duty ratios at the critical luminance GD_cri, GM_cri, and GB_cri or more.

As described above, the light data signal controller 810 selects one linear gamma curve, γ_Bright, γ_Middle, or γ_Dark, from among a plurality of linear gamma curves γ_Bright, γ_Middle, and γ_Dark. FIG. 6 shows three linear gamma curves, that is, a first linear gamma curve γ_Bright corresponding to a bright image, a second linear gamma curve γ_Dark corresponding to a dark image, and a third linear gamma curve γ_Middle corresponding to an image in a middle brightness range.

The minimum duty ratio DB_min of the first linear gamma curve γ_Bright may be larger than the minimum duty ratio DM_min of the third linear gamma curve γ_Middle, and the minimum duty ratio DM_min of the third linear gamma curve γ_Middle may be larger than the minimum duty ratio DD_min of the second linear gamma curve γ_Dark.

The critical luminance GB_cri of the first linear gamma curve γ_Bright may be smaller than the critical luminance GM_cri of the third linear gamma curve γ_Middle, and the critical luminance GM_cri of the third linear gamma curve γ_Middle may be smaller than the critical luminance GD_cri of the second linear gamma curve γ_Dark. FIG. 6 shows an example where the critical luminance GB_cri of the first linear gamma curve γ_Bright corresponds to a gray level 77, the critical luminance GM_cri of the third linear gamma curve γ_Middle corresponds to a gray level 128 and the critical luminance GM_cri of the second gamma curve γ_Dark corresponds to a gray level 179.

A method of selecting one linear gamma curve γ_Bright, γ_Middle, or γ_Dark from among a plurality of linear gamma curves γ_Bright, γ_Middle, and γ_Dark shown in FIG. 6 is as follows.

If the average image luminance R_DB during prescribed frames is smaller than the critical luminance GB_cri of the first linear gamma curve γ_Bright (sel_Dark area), the second linear gamma curve γ_Dark is selected. If the average image luminance R_DB during prescribed frames is larger than the critical luminance GD_cri of the second linear gamma curve γ_Dark (sel_Bright area), the first linear gamma curve γ_Bright is selected. If the average image luminance R_DB during prescribed frames is larger than the critical luminance GB_cri of the first linear gamma curve γ_Bright and smaller than the critical luminance GD_cri of the second linear gamma curve γ_Dark (sel_Middle area), the third linear gamma curve γ_Middle is selected.

By selecting one linear gamma curve out of a plurality of linear gamma curves γ_Bright, γ_Middle, and γ_Dark, the gamma coefficient is determined, and accordingly the duty ratio of the light data signal is determined. For example, the duty ratio of the light data signal corresponding to the average image luminance Gn of a current frame can be found on the selected linear gamma curve γ_Bright, γ_Middle, or γ_Dark.

As described with reference to FIG. 6, according to an embodiment of the present invention, it is possible to adjust the duty ratio of the light data signal in accordance with the luminance of an image to be displayed on the display panel by using the linear gamma curves γ_Bright, γ_Middle, and γ_Dark. Therefore, as compared with a case in which nonlinear gamma curves are used, it is possible to store the linear gamma curves γ_Bright, γ_Middle, and γ_Dark with a small memory space in forms of a lookup table, and to simplify the operation to adjust the duty ratio of the light data signal. As a result, it is possible to reduce manufacturing costs.

In addition, one linear gamma curve is selected out of from among a plurality of linear gamma curves γ_Bright, γ_Middle, and γ_Dark according to the average image luminance R_DB, and the duty ratio of the light data signal is adjusted on the basis of the selected linear gamma curve. Therefore, it is possible to determine different gamma coefficients in accordance with the luminance of an image displayed on the display panel 300. As a result, display quality may be improved as compared with a case in which a fixed gamma coefficient is used.

Figure 7:
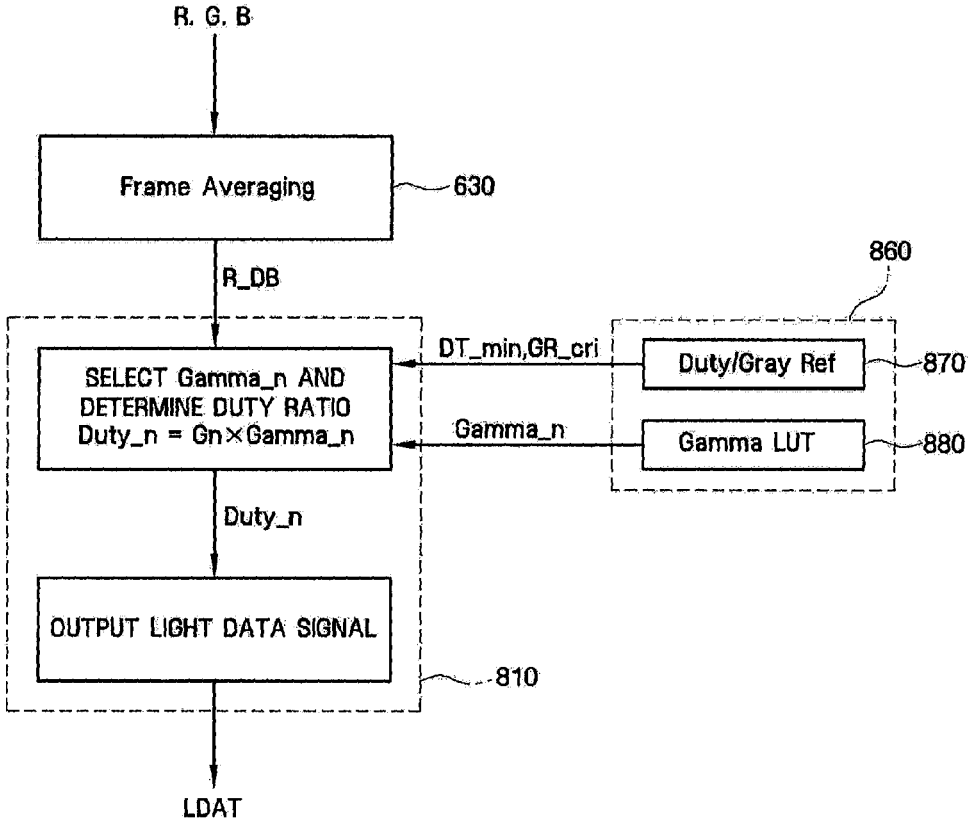
FIG. 7 is a conceptual view illustrating luminance adjustment of backlight in the display device and the method of driving the same according to the embodiment of the present invention.

One embodiment of the present invention describes luminance adjustment of backlight in the display device and the method of driving it, illustrated in FIG. 7. FIG. 7 describes a process of determining the duty ratio of the light data signal in accordance with the average image luminance during prescribed frames in the display device and the method of driving it. FIG. 7 is a conceptual view illustrating luminance adjustment of backlight in the display device and the method of driving the same according to an embodiment of the present invention.

First, the representative value determining unit 630 determines the average image luminance R_DB of images to be displayed on the display panel 300 (Frame Averaging). As shown in the drawing, the representative value determining unit 630 averages the gray levels of the first image signals R, G, and B to determine the average image luminance R_DB. Alternatively, the average image luminance R_DB may be determined by averaging the gray levels of the second image signals IDAT.

R_DB may be the average image luminance R_DB during prescribed frames. For example, the average prescribed image luminance R_DB may be expressed by Equation 1.

$$\text{R_DB} = (1/m) * \sum_{l=1}^{m} G(n-l) \quad \text{[Equation 1]}$$

G(n) is the average image luminance of the current frame, and G(n−m) to G(n−l) mean the average image luminance of the previous frames. The number of prescribed frames, that is, the number m of previous frames may be set by the user. For example, m may be 10 for the past 10 frames. Therefore, the average image luminance R_DB during the prescribed frames may be the average image luminance of the previous frames.

Next, the light data signal generator 810 in the backlight driver (see reference numeral 800 in FIG. 1) selects the gamma coefficient Gamma_n and determines the duty ratio Duty_n of the light data signal in the current frame on the basis of the selected gamma coefficient Gamma_n.

The light data signal generator 810 reads from the memory 860 the duty/gray reference values 870, that is, the minimum duty ratios DT_min and the critical luminance GR_cri, generates a plurality of linear gamma curves Data_γ on the basis of the minimum duty ratios DT_min and the critical luminance GR_cri, and store a plurality of linear gamma curves 880 in the memory 860 in forms of a lookup table.

The light data signal generator 810 selects one linear gamma curve out of a plurality of linear gamma curves 880 in forms of a lookup table stored in the memory 860 in accordance with the average image luminance R_DB. The gamma coefficient is determined on the basis of the selected linear gamma curve, and then the duty ratio Duty n of the light data signal in the current frame is determined on the basis of the gamma coefficient Gamma n. For example, the duty ratio Duty of the light data signal in the current frame is expressed by Equation 2.

$$\text{Duty_}n = Gn * \text{Gamma_}n \quad \text{[Equation 2]}$$

Next, the light data signal generator 810 outputs the light data signal LDAT having a duty ratio corresponding to the determined gamma coefficient Gamma_n.

It is also possible to adjust luminance of backlight in accordance with the average image luminance of images to be displayed on the display panel. Therefore power consumption is reduced and display quality improved.

Hereinafter, a display device and a method of driving it according to another embodiment of the present invention will be described with reference to FIGS. 8 to 10. The same parts as those in the foregoing embodiment are represented by the same reference numerals, and for convenience, overlap descriptions will be omitted.

Figure 8:
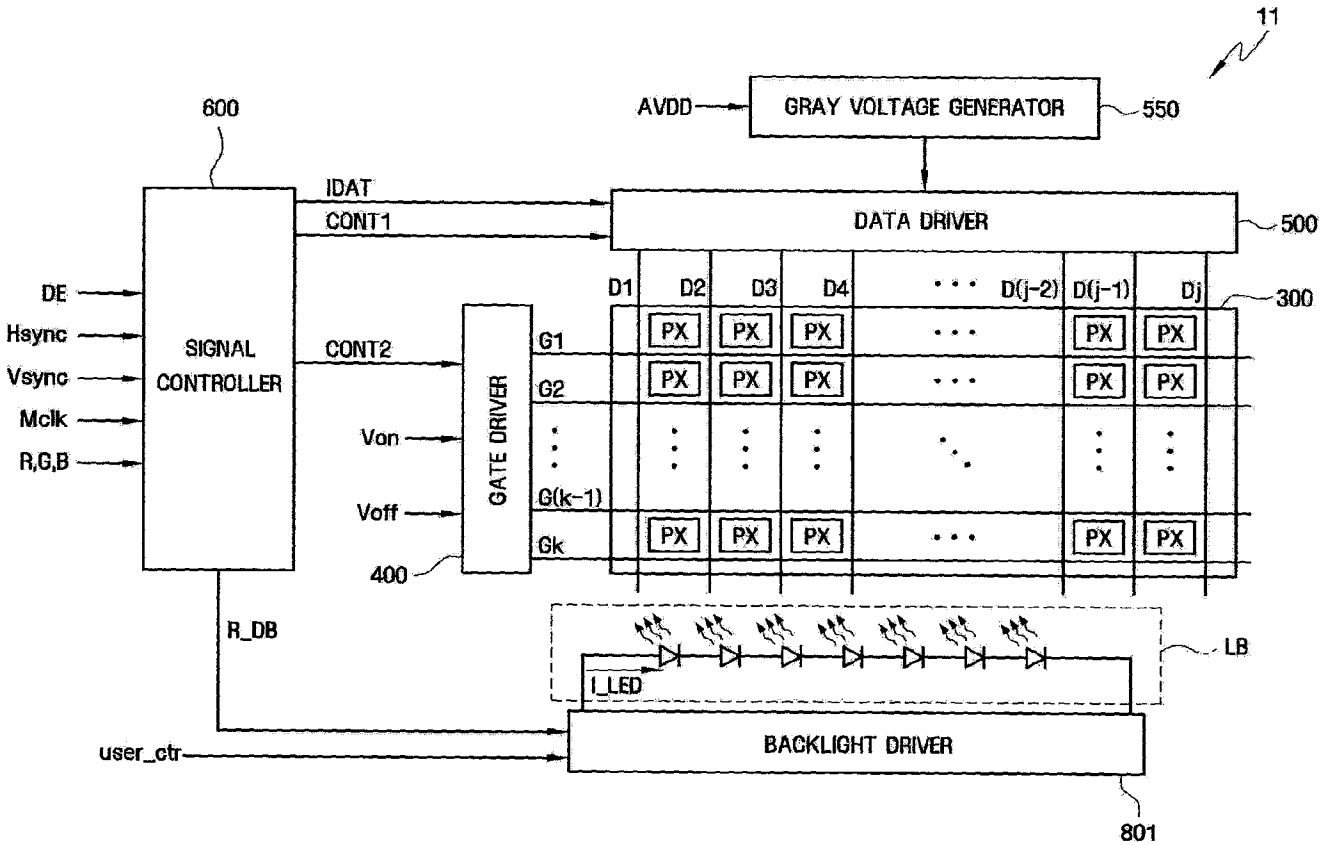
FIG. 8 is a block diagram illustrating a display device and a method of driving the same according to another embodiment of the present invention.

Referring to FIG. 8, a display device 11 includes a display panel 300, a signal controller 600, a gray voltage generator 550, a gate driver 400, a data driver 500, a backlight driver 801, and a light-emission block LB connected to the backlight driver 801.

A user luminance adjustment signal user_ctr is input to the backlight driver 801. The user may perform an operation to adjust the luminance of backlight separately from the above-described average image luminance. The user luminance adjustment signal user_ctr corresponds to the user's input.

The backlight driver 801 increases or decreases the minimum duty ratio of each gamma curve by an offset value (see offset in FIG. 9) corresponding to the user's input. Unlike the configuration shown in FIG. 1, the user luminance adjustment signal user_ctr is supplied to the backlight driver 801 through the signal controller 600. In this case, the signal controller 600 determines an offset value corresponding to the user luminance adjustment signal user_ctr, and supplies the determined offset value to the backlight driver 801. Hereinafter, for convenience of explanation, a case will be described in which the backlight driver 801 determines an offset value corresponding to the user luminance adjustment signal user_ctr.

Figure 9:
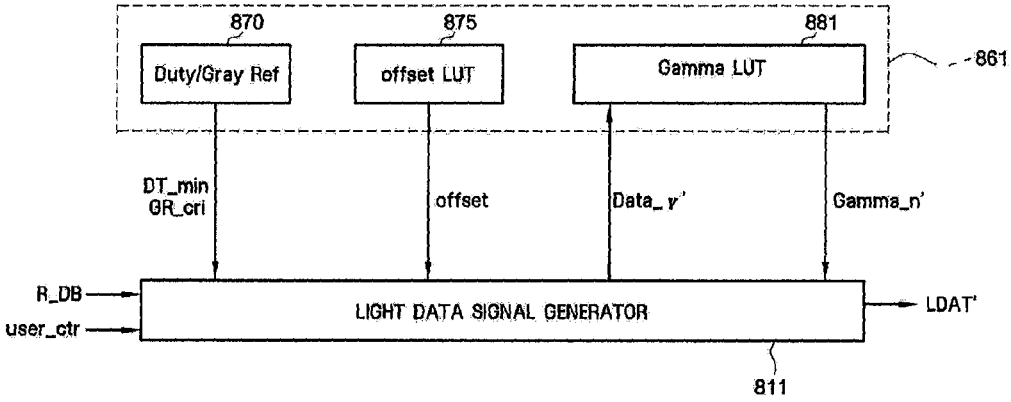
FIG. 9 is a block diagram illustrating a memory and a light data signal controller in a backlight driver shown in FIG. 8.

FIG. 9 is a block diagram illustrating a memory and a light data signal controller in the backlight driver shown in FIG. 8.

Referring to FIG. 9, the memory 861 stores duty/gray reference values (Duty/Gray Ref. 870), an offset lookup table (offset LUT) 875, and a plurality of gamma curves (Gamma LUT) 881 in a lookup table.

The offset lookup table 875 stores an offset value corresponding to the user luminance adjustment signal user_ctr. If the user luminance adjustment signal user_ctr is to increase the luminance of backlight, the offset value offset is positive, and if the user luminance adjustment signal user_ctr decreases the luminance of the backlight, the offset value is negative. The light data signal generator 810 reads from the offset lookup table 875 an offset value corresponding to the user luminance adjustment signal user_ctr.

A plurality of linear gamma curves 881 in forms of a lookup table may be stored by the light data signal generator 811. The light data signal generator 811 reads an offset value from the memory 861, and offsets a plurality of linear gamma curves by the offset value offset to generate a plurality of offset linear gamma curves Data_γ'. A plurality of offset linear gamma curves Data_γ' are stored in the memory 861 in the form of a lookup table.

The light data signal generator 810 determines a gamma coefficient Gamma_n' on the basis of one linear gamma curve out of the offset linear gamma curves 881 that are stored in a lookup table in the memory 861 in accordance with the average image luminance R_DB.

The light data signal generator 811 determines the gamma coefficient Gamma_n'from the memory 861 in accordance with the average image luminance R_DB, and generates a light data signal LDAT' having a duty ratio corresponding to the determined gamma coefficient Gamma_n'.

Figure 10:
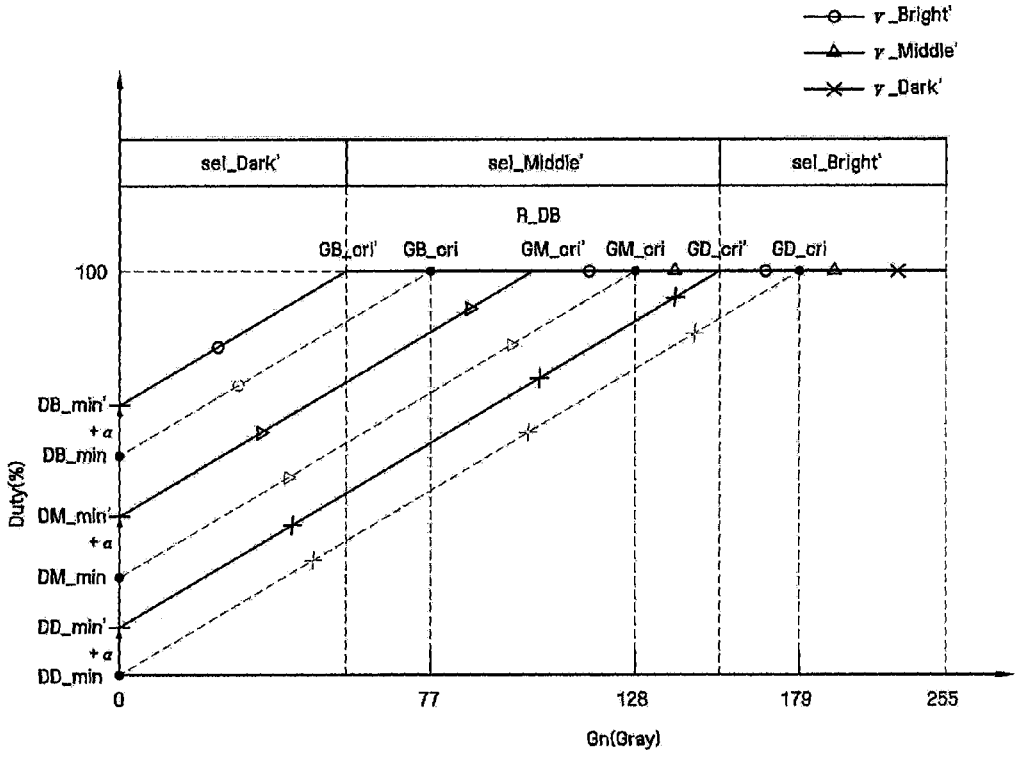
FIG. 10 is a graph illustrating the operation of the light data signal controller shown in FIG. 9 to select a gamma coefficient.

FIG. 10 is a graph illustrating how the light data signal controller shown in FIG. 9 selects a gamma coefficient. In FIG. 10, the offset value is indicated by α. FIG. 10 shows an example where α is positive.

From FIG. 10, it can be seen that the linear gamma curves γ_Bright', γ_Middle', and γ_Dark' are offset by the offset value α. For comparison, the linear gamma curves before being offset are indicated by dotted lines.

Specifically, it can be seen that the minimum duty ratios DB_min, DM_min, and DD_min are increased by the offset value α. That is, the minimum duty ratios DB_min', DM_min', and DD_min' of the linear gamma curves γ_Bright', γ_Middle', and γ_Dark' are individually the same as the values obtained by adding the offset value α to the minimum duty ratios DB_min, DM_min, and DD_min of the linear gamma curves γ_Bright, γ_Middle, and γ_Dark.

In addition, it can be seen that the critical luminance GD_cri', GM_cri', and GB_cri'of the linear gamma curves γ_Bright', γ_Middle', and γ_Dark' individually become smaller than the critical luminance GD_cri, GM_cri, and GB_cri of the linear gamma curves γ_Bright, γ_Middle, and γ_Dark before being offset.

Furthermore, it can be seen that, as compared with the areas before being offset, an area (sel_Dark' area) where the second linear gamma curve γ_Dark' is selected is narrowed, and an area (sel_Bright' area) where the first linear gamma curve γ_Bright' is selected is widened.

As such, the gamma curves γ_Bright', γ_Middle', and γ_Dark' are all shifted in the positive direction, and the luminance of backlight is fully brightened. Meanwhile, though not shown in the drawing, when the offset value a is negative, similarly, the linear gamma curves γ_Bright', γ_Middle', and γ_Dark' are all offset in a negative direction, the luminance of backlight is fully darkened. Therefore, it is possible to adjust the luminance of backlight in accordance with the user luminance adjustment signal user_ctr input by the user separately from the average image luminance.

Although the present invention has been described in connection with the exemplary embodiments of the present invention, it will be apparent to those skilled in the art in light of the foregoing that various modifications and changes may be made thereto without departing from the scope and spirit of the invention. Therefore, it should be understood that the above embodiments are not limitative, but illustrative in all aspects.

What is claimed is:

1. A display device comprising:

a display panel configured for displaying images corresponding to a plurality of sequential frames whose images are represented by received image signals;

a light-emission block configured for supplying backlight to the display panel; and a backlight driver configured for outputting for each respective frame a corresponding backlighting level determining data signal that defines a corresponding backlighting-level-determining duty ratio for the frame, which ratio is used for determining a respective backlighting luminance level to be produced by the light-emission block for the respective frame, wherein the backlight driver stores definitions of a plurality of piecewise linear gamma curves relating the luminance level to the duty ratio, and wherein the backlight driver is configured to automatically select, for use during each respective frame, a respective one of the piecewise linear gamma curves in accordance with a running average image luminance factor that is determined for the respective frame on the basis of a prescribed number of two or more preceding frames, and wherein the duty ratio of the backlighting level determining data signal for a respective one of the plurality of sequential frames is determined on the basis of the selected piecewise linear gamma curve, where each of the piecewise linear gamma curves represents the relationship between the respective backlighting luminance level to be produced by the light-emission block for the respective frame and the corresponding duty ratio represented by the backlighting level determining data signal.

2. The display device of claim 1, wherein each of the piecewise linear gamma curves is characterized by a minimum duty ratio value, which is a duty ratio corresponding to minimum image luminance, and is further characterized by a critical luminance value, which is a minimum value of the average image luminance corresponding to a maximum duty ratio of the backlighting level determining data signal.

3. The display device of claim 2, wherein each of the piecewise linear gamma curves is definable on an xy coordinate plane, which has an x-coordinate axis representing the average image luminance of a current frame and a y-coordinate axis representing the duty ratio of the backlighting level determining data signal, where the respective piecewise linear gamma curve includes a line connecting a point on the xy coordinate plane corresponding to the minimum duty ratio and a point corresponding to the critical luminance, and a line showing the maximum duty ratio at the critical luminance.

4. The display device of claim 1, wherein the plurality of piecewise linear gamma curves include a first piecewise linear gamma curve corresponding to a bright image, and a second piecewise linear gamma curve corresponding to a dark image.

5. The display device of claim 4, wherein:

each of the piecewise linear gamma curves is characterized by a minimum duty ratio value corresponding to minimum image luminance, and is further characterized by a critical luminance value, which is a minimum value of the average image luminance corresponding to a maximum duty ratio of the backlighting level determining data signal;

the minimum duty ratio value of the first piecewise linear gamma curve is larger than the minimum duty ratio value of the second piecewise linear gamma curve;

and the critical luminance value of the first piecewise linear gamma curve is smaller than the critical luminance value of the second piecewise linear gamma curve.

6. The display device of claim 5, wherein:

if the average image luminance during the prescribed frames is smaller than the critical luminance of the first linear gamma curve, the second linear gamma curve is selected; and if the average image luminance during the prescribed frames is larger than the critical luminance of the second linear gamma curve, the first linear gamma curve is selected.

7. The display device of claim 4, wherein:

each of the linear gamma curves is determined by a minimum duty ratio, which is a duty ratio corresponding to minimum image luminance, and critical luminance, which is a minimum value of the average image luminance corresponding to a maximum duty ratio of the light data signal;

the backlight driver includes a memory storing the minimum duty ratios and the critical luminance; and the minimum duty ratio and the critical luminance stored in the memory are changeable by the user.

8. The display device of claim 7, wherein:

the user performs an operation to adjust the luminance of backlight separately from the average image luminance; and the minimum duty ratio of each of the gamma curves increases or decreases by an offset value corresponding to a user's input.

9. The display device of claim 1, wherein the light-emission block includes a plurality of light-emitting diodes (LEDs).

10. The display device of claim 1, wherein the backlight driver is configured to execute an operation to select one piecewise linear gamma curve and to accordingly determine the duty ratio of the backlighting level determining data signal for a corresponding frame.

11. The display device of claim 1, wherein the number of prescribed frames is defined by a user.

12. The display device of claim 1, wherein each of the piecewise linear gamma curves represents a respective relationship between average image luminance in a current frame and the duty ratio of the backlighting level determining data signal for the respective frame.

13. The display device of claim 1, wherein:

the average image luminance during the prescribed frames is the average image luminance during previous frames; and the duty ratio of the light data signal corresponding to a current frame is determined from the gamma curve corresponding to the average image luminance.

14. A method of driving a display device, where the display panel is configured for displaying images corresponding to a plurality of sequential frames whose images are represented by received image signals, the method comprising:

extracting average image luminance values for each of respective frames during a time period corresponding to a prescribed number of the sequential frames;

determining by machine means a running average image luminance factor that is determined for a respective current frame on the basis of the prescribed number of preceding frames;

selecting one of a plurality of piecewise linear gamma curves in accordance with the running average image luminance factor, the selected piecewise linear gamma curve representing a relationship between the average image luminance of the current frame and a duty ratio corresponding to that average image luminance;

outputting a light data signal whose duty ratio is determined on the basis of the selected piecewise linear gamma curve; and supplying backlight corresponding to the light data signal to a panel of the display device to thereby display the corresponding images.

15. The method of claim 14, wherein each of the piecewise linear gamma curves is characterized by a minimum duty ratio value, which is a duty ratio corresponding to minimum image luminance, and is further characterized by a critical luminance value, which is a minimum value of the average image luminance corresponding to a maximum duty ratio of the light data signal.

16. The method of claim 15, wherein each of the piecewise linear gamma curves is definable by a line connecting a point corresponding to the minimum duty ratio and a point corresponding to the critical luminance, and a line showing the maximum duty ratio at the critical luminance as drawn on an xy coordinate plane, which has an x-coordinate axis representing the average image luminance of a current frame and a y-coordinate axis representing the duty ratio of the light data signal.

17. The method of claim 15, wherein:

the user is allowed to perform an operation to adjust the luminance of backlight separately from the average image luminance; and the minimum duty ratio of each of the linear gamma curves increases or decreases by an offset value corresponding to a user's input.

18. The method of claim 14, wherein the plurality of piecewise linear gamma curves include a first piecewise linear gamma curve corresponding to a bright image, and a second piecewise linear gamma curve corresponding to a dark image.

19. The method of claim 18, wherein:

each of the linear gamma curves has a minimum duty ratio, which is a duty ratio corresponding to minimum image luminance, and critical luminance, which is a minimum value of the average image luminance corresponding to a maximum duty ratio of the light data signal;

the minimum duty ratio of the first linear gamma curve is larger than the minimum duty ratio of the second linear gamma curve; and the critical luminance of the first linear gamma curve is smaller than the critical luminance of the second linear gamma curve.

20. The display device of claim 19, wherein:

if the average image luminance during the prescribed frames is smaller than the critical luminance of the first linear gamma curve, the second linear gamma curve is selected; and if the average image luminance during the prescribed frames is larger than the critical luminance of the second linear gamma curve, the first linear gamma curve is selected.

* * * * *